US010376933B2

(12) United States Patent
Pineda

(10) Patent No.: US 10,376,933 B2
(45) Date of Patent: Aug. 13, 2019

(54) CLEANING DEVICE FOR BARREL OF PAINTBALL GUN

(71) Applicant: HK ARMY INC., Gardena, CA (US)

(72) Inventor: Jason Pineda, Gardena, CA (US)

(73) Assignee: HK ARMY INC., Gardena, CA (US)

( * ) Notice: Subject to any disclaimer, the term of this patent is extended or adjusted under 35 U.S.C. 154(b) by 269 days.

(21) Appl. No.: 15/665,946

(22) Filed: Aug. 1, 2017

(65) Prior Publication Data

US 2018/0257118 A1 Sep. 13, 2018

Related U.S. Application Data

(60) Provisional application No. 62/469,672, filed on Mar. 10, 2017.

(51) Int. Cl.

*B08B 9/043* (2006.01)
*F41B 11/70* (2013.01)
*F41A 29/02* (2006.01)

(52) U.S. Cl.

CPC ..... *B08B 9/0436* (2013.01); *F41A 29/02* (2013.01); *F41B 11/70* (2013.01)

(58) Field of Classification Search

CPC ..... B08B 9/0436; F41A 29/02; F41B 11/70
USPC ..... 15/104.16
See application file for complete search history.

(56) References Cited

U.S. PATENT DOCUMENTS 705,396 A * 7/1902 Garrison ..... F41A 29/02 15/104.18
D134,303 S 11/1942 Hoerle
2,361,395 A 10/1944 Gilligan
2,363,520 A 11/1944 Fish
2,379,962 A 7/1945 Hoerle
2,616,109 A * 11/1952 Gardner ..... F41A 29/02 15/104.165
2,749,565 A 6/1956 Stamm, Jr.
(Continued)

FOREIGN PATENT DOCUMENTS

JP 2000312868 A2 11/2000

OTHER PUBLICATIONS

Double Swab, 10 pcs/lot Paintball Double Swab for Cleaning Paintball Gun Barrel dated May 23, 2017 https://www.aliexpress.com/item/PAINTBALL-DOUBLE-SWAB-for-clear-paintball-gun-barrel-silas/32599199216.html?spm=2114.40010708.4.35.E44YbP, 3 pp.

*Primary Examiner* — Weilun Lo
(74) *Attorney, Agent, or Firm* — Knobbe, Martens, Olson & Bear LLP

(57) ABSTRACT

A swab device for cleaning the barrel of a paintball gun has a shaft and a sleeve is slidably mounted over the shaft. An absorbent material is wrapped about the sleeve. A cap member is pivotally attached to a distal end of the shaft by a spring that biases the cap to a retracted position where it faces outward from a side surface of the shaft so the cap extends along a plane spaced from and substantially parallel to an axis of the shaft. The cap can be pivoted by the sleeve to a deployed position where it is substantially perpendicular to the axis of the shaft. The cap has a resilient circumferential portion that engages an inner surface of the barrel when the cap is in the deployed position to clean (e.g., squeegee) the inner surface of the barrel while the absorbent material absorbs any liquid from broken paint balls in the barrel as the shaft is pulled out of the barrel.

16 Claims, 5 Drawing Sheets

(56) References Cited

U.S. PATENT DOCUMENTS

| | | | | |
|---|---|---|---|---|
| 2,798,238 | A * | 7/1957 | Rogovin | F41A 29/02 15/104.16 |
| 5,038,509 | A * | 8/1991 | Stephan | A46B 3/18 15/104.16 |
| 5,447,572 | A | 9/1995 | La Clair | |
| 5,465,448 | A | 11/1995 | Tajima et al. | |
| 6,088,866 | A | 7/2000 | Hedge | |
| 7,055,279 | B2 | 6/2006 | Flores | |
| 7,377,003 | B1 * | 5/2008 | Dochterman | F41B 11/00 15/104.15 |
| 8,176,592 | B1 | 5/2012 | Carpenter et al. | |
| 8,448,370 | B2 | 5/2013 | Williams | |
| 9,228,790 | B2 | 1/2016 | Stephens et al. | |
| 9,505,039 | B1 * | 11/2016 | Green | B08B 1/003 |
| 9,638,486 | B2 | 5/2017 | Evans et al. | |
| 2007/0294930 | A1 * | 12/2007 | Mays | F41A 29/02 42/95 |
| 2009/0283115 | A1 * | 11/2009 | Dentico | F41A 29/00 134/22.1 |
| 2012/0102667 | A1 * | 5/2012 | Higgins | B08B 9/00 15/104.16 |
| 2013/0198983 | A1 * | 8/2013 | Frederick | F41A 29/02 15/104.16 |
| 2013/0269234 | A1 * | 10/2013 | Williams | F41A 29/02 42/95 |
| 2016/0175900 | A1 * | 6/2016 | Evans | F41A 29/02 15/104.16 |
| 2016/0175901 | A1 * | 6/2016 | Evans | F41A 29/02 15/104.16 |

* cited by examiner

CLEANING DEVICE FOR BARREL OF PAINTBALL GUN

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application claims the benefit of U.S. Provisional Application No. 62/469,672, filed Mar. 10, 2017 and titled CLEANING DEVICE FOR BARREL OF PAINTBALL GUN, the entirety of which is incorporated by reference and should be considered a part of this specification.

BACKGROUND

Field

Aspects of the present disclosure are directed to a cleaning device for paintball equipment, and in particular to a cleaning device for the barrel of a paintball gun.

Description of the Related Art

Paintball is a popular sport, where balls filled with paint (i.e., "paintballs") are shot through a barrel of a paintball gun, usually a pneumatically actuated gun. The paintballs break when they strike a surface (e.g., a target, a competitor in a paintball match) after having been expelled from the barrel of the paintball gun. Sometimes, paintballs break within the barrel of the gun and negatively affect the accuracy of the paintball gun until the barrel of the paintball gun is cleaned to remove the broken paintball material from the barrel.

Existing cleaning devices are inadequate in that they are unable to remove as much of the broken paintball material as possible, including material at the end of the barrel that is opposite the open end of the barrel.

SUMMARY

Accordingly, there is a need for an improved cleaning device for removing broken paintballs from the barrel of a paintball gun.

In accordance with one aspect of the invention, a cleaning device (e.g., swab) is provided. The cleaning device comprises a first elongate member (e.g., shaft, stick) that optionally has an absorbent material (e.g., a fuzzy or felt like material, foam or sponge like material, fabric of natural or synthetic fibers) wrapped about at least a portion of the first elongate member. The cleaning device also comprises a second elongate member (e.g., shaft, stick) that optionally has an absorbent material (e.g., a fuzzy or felt like material, foam or sponge like material, fabric of natural or synthetic fibers) wrapped about at least a portion of the second elongate material. The first elongate member and second elongate member are connected by a connecting member (e.g., connector) that has a flexible joint (e.g., hinge), where the first and second elongate members extend from opposite sides of the connecting member and the flexible joint allows the cleaning device to be pivoted between a first position where the first and second elongate members extend generally along a single axis (e.g., are in line), to a second position, where the first elongate member extends at an angle less than 180 degrees relative to the second elongate member, where the cleaning device bends at the flexible joint. The cleaning device can further comprise a cap member that is pivotally attached to a distal end of the second elongate member by a spring (e.g., torsion spring coupled between a surface of the cap member and a surface of the second elongate member) that biases the cap member to a retracted position where it faces out from a side surface of the second elongate member (e.g., the face of the cap member extends along a plane generally parallel to an axis of the second elongate member). The cap member can be pivoted so that it faces along the axis of the second elongate member (e.g., a deployed position, where the face of the cap member extends along a plane generally perpendicular to the axis of the second elongate member). The cap can be pivoted from the retracted position to the deployed position by a sleeve that is coaxial with the second elongate member and can slide (e.g., over the second elongate member) to engage a surface of the cap member to pivot the cap member into the deployed position.

In accordance with another aspect, a cleaning assembly for a paintball gun barrel is provided. The assembly comprises a first shaft having longitudinal axis and extending from a proximal portion to a distal portion, a second shaft having a longitudinal axis and extending from a proximal portion to a distal portion, and a connector having openings at opposite ends of the connector configured to receive the proximal portions of the first and second shafts therein. The assembly also comprises a sleeve slidably coupled over the second shaft and coaxial with the second shaft, the sleeve having a distal edge. The assembly also comprises a cap member having a circular outer perimeter and pivotably coupled to the distal portion of the second shaft via a pin that extends through the distal portion of the second shaft and a pair of walls of the cap member disposed on opposite sides of the distal portion of the second shaft. The cap member has an edge configured to engage the distal edge of the sleeve. The cap member is configured to pivot between a first orientation where the circular outer perimeter extends along a plane that is spaced from and substantially parallel to the longitudinal axis of the second shaft and a second orientation where the circular outer perimeter extends along a plane that is substantially perpendicular to the longitudinal axis of the second shaft. The assembly also comprises a spring coupled to a surface of the cap member and a surface of the second shaft and configured to exert a force on the cap member to bias the cap member to the first position. Sliding the sleeve toward the distal portion of the second shaft causes the distal edge of the sleeve to engage the edge of the cap member to pivot the cap member from the first orientation toward the second orientation, and wherein sliding the sleeve toward the proximal portion of the second shaft causes the distal edge of the sleeve to disengage from the edge of the cap member, causing the spring to bias the cap member to the first orientation.

In accordance with another aspect, a cleaning assembly for a paintball gun barrel is provided. The assembly comprises a shaft having a longitudinal axis and extending from a proximal portion to a distal portion, and a sleeve slidably coupled over the shaft and coaxial with the shaft, the sleeve having a distal edge. The assembly also comprises a cap member having a circular outer perimeter and pivotably coupled to the distal portion of the shaft via a pin that extends through the distal portion of the shaft and a pair of walls of the cap member disposed on opposite sides of the distal portion of the shaft. The cap member has an edge configured to engage the distal edge of the sleeve. The cap member is configured to pivot between a first orientation where the circular outer perimeter extends along a plane that is spaced from and substantially parallel to the longitudinal axis of the shaft and a second orientation where the circular outer perimeter extends along a plane that is substantially perpendicular to the longitudinal axis of the shaft. The assembly also comprises a spring coupled to a surface of the cap member and a surface of the shaft and configured to exert a force on the cap member to bias the cap member to the first position. Sliding the sleeve toward the distal portion of the shaft causes the distal edge of the sleeve to engage the edge of the cap member to pivot the cap member from the first orientation toward the second orientation against the force of the spring, and wherein sliding the sleeve toward the proximal portion of the shaft causes the distal edge of the sleeve to disengage from the angled edge of the cap member, causing the spring to bias the cap member to the first orientation.

In accordance with another aspect of the invention a cleaning assembly for a paintball gun barrel is provided. The assembly comprises a first shaft having longitudinal axis and extending from a proximal portion to a distal portion, and a second shaft having a longitudinal axis and extending from a proximal portion to a distal portion. The assembly also comprises a connector having openings at opposite ends of the connector configured to receive the proximal portions of the first and second shafts therein. The connector is fixed to the proximal portions of the first and second shafts with a pair of threaded fasteners that extend through a wall of the connector and at least partially through the proximal portions of the first and second shafts. The connector defines a hinge generally at a longitudinal center of the connector that is configured to allow pivoting of the first shaft relative to the second shaft. An absorbent material is disposed over one or both of the first shaft and the second shaft and is configured to contact an inner surface of a barrel of a paintball gun when inserted therein.

DETAILED DESCRIPTION

FIGS. 1-8 show a cleaning device 100 or swab for use in cleaning the barrel of a paintball gun, for example to remove broken paintball material from the barrel. Though described in connection with the cleaning of a barrel of a paintball gun, the cleaning device 100 or swab can be used to clean barrels in other devices (e.g., firearms).

Figure 1:
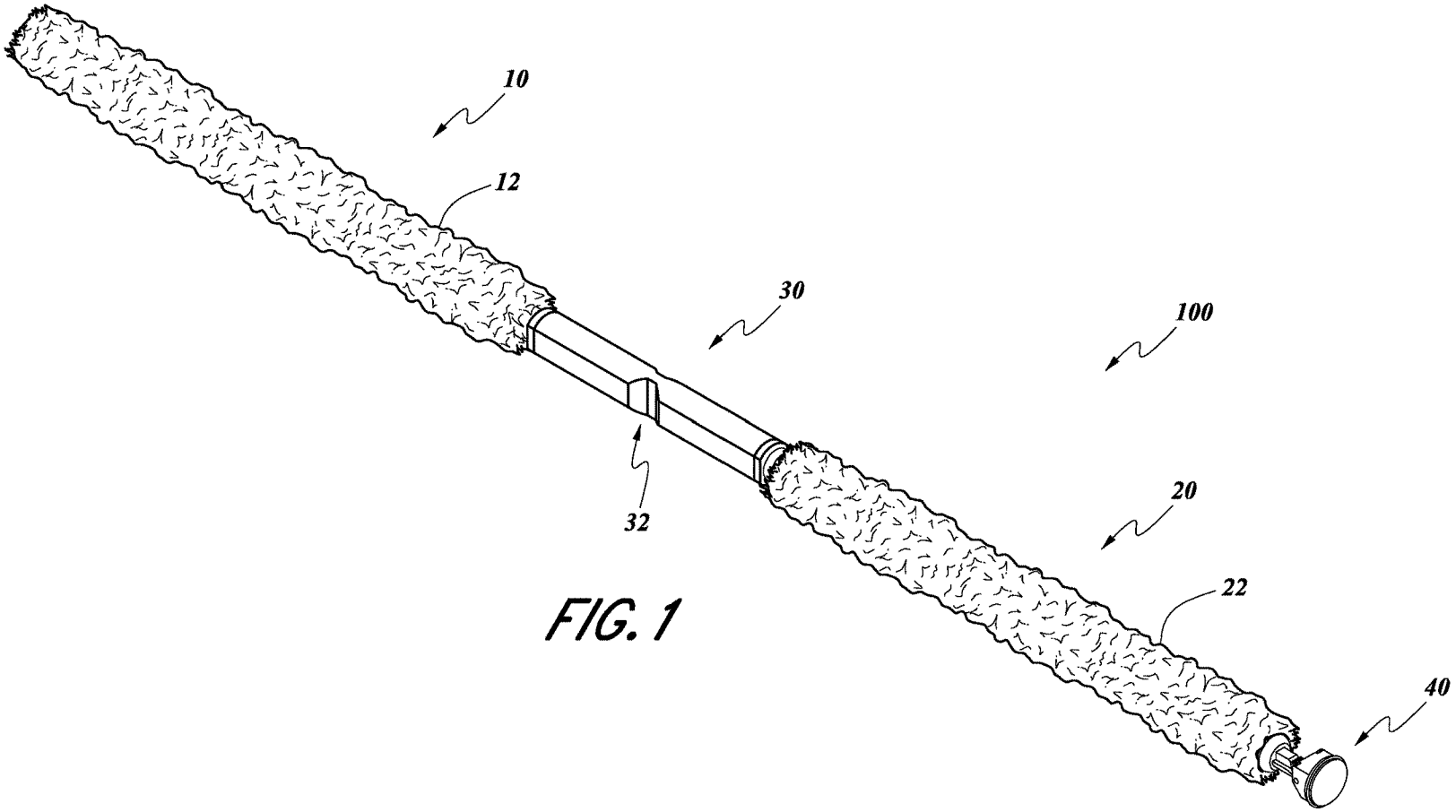
FIG. 1 is a perspective view of a cleaning device.
Figure 2:
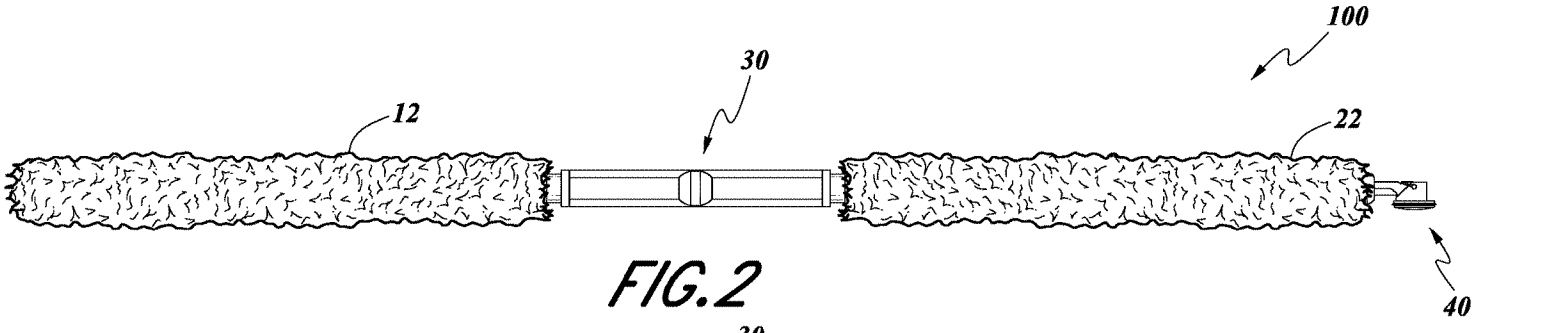
FIG. 2 is a top view of the cleaning device.
Figure 3:
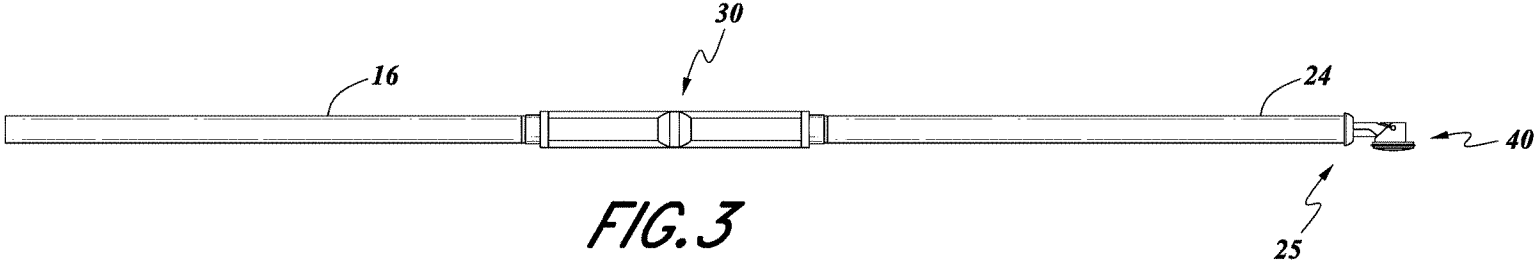
FIG. 3 is a top view of the cleaning device with the absorbent material removed, showing a sleeve slidably coupled to an elongate member of the cleaning device in one position and the end cap in a first position.
Figure 4:
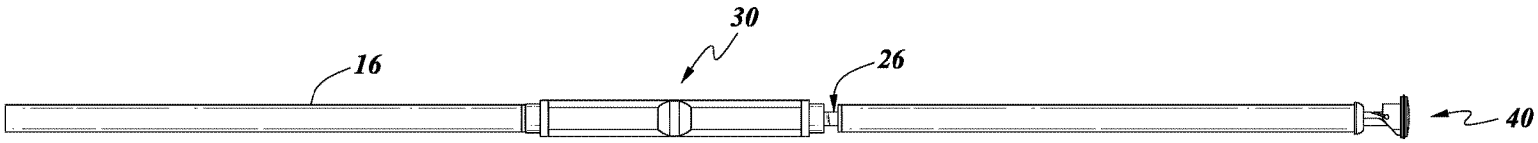
FIG. 4 is a top view of the cleaning device with the absorbent material removed, showing the sleeve in a second position relative to the elongate member, end the end cap in a second position.
Figure 5:
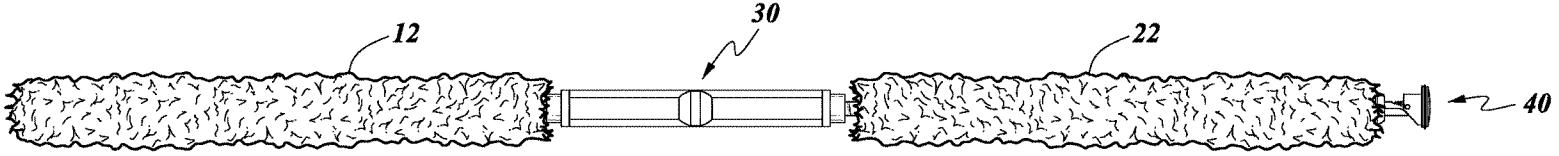
FIG. 5 is a top view of the absorbent material wrapped about the sleeve of the cleaning device, where the cap member pivots toward a deployed position when the sleeve moves toward the distal end of the elongate member.
Figures 6A, 6B, 6C:
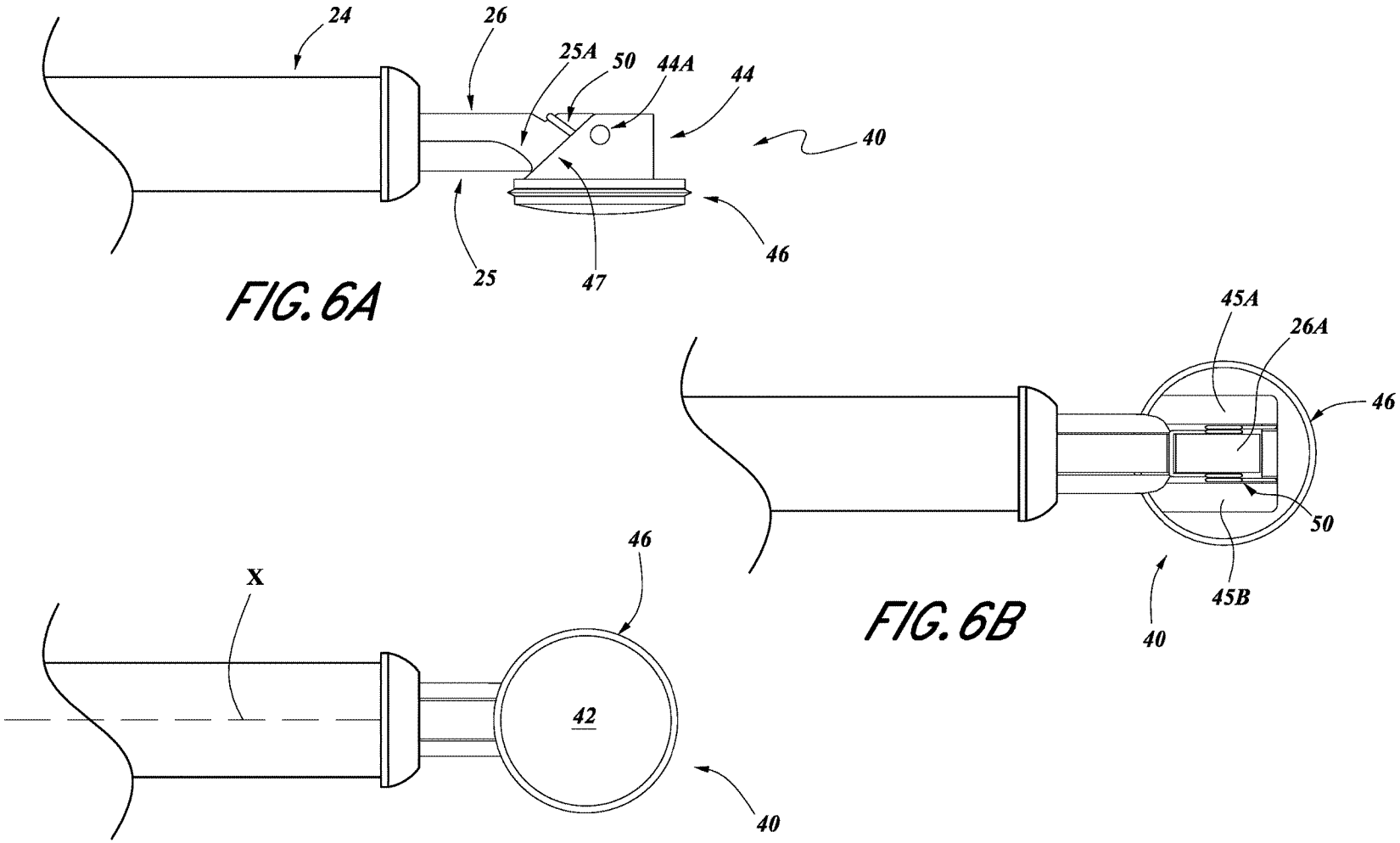
FIG. 6A-6C are enlarged top, side and rear views of the end cap in a retracted position.
Figure 7B:
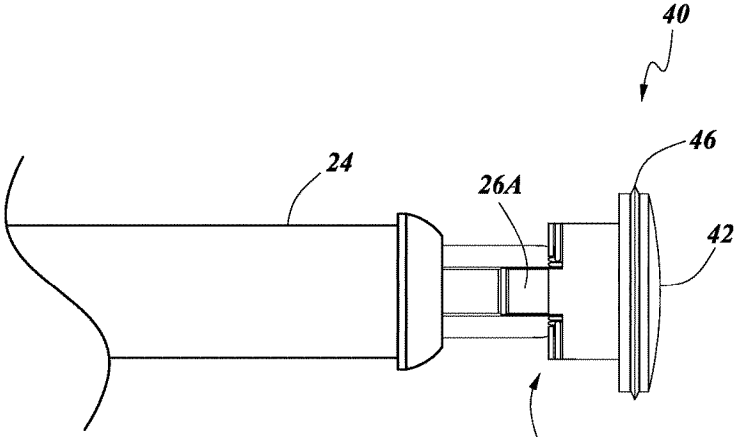
FIG. 7A-7C are enlarged top, side and rear views of the end cap in a deployed position.
Figure 7A:
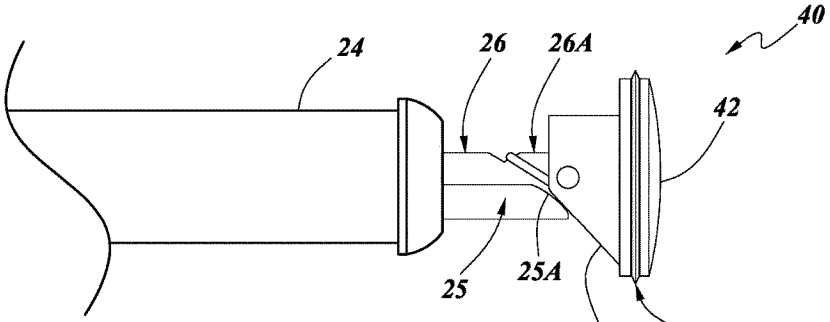
Figure 7C:
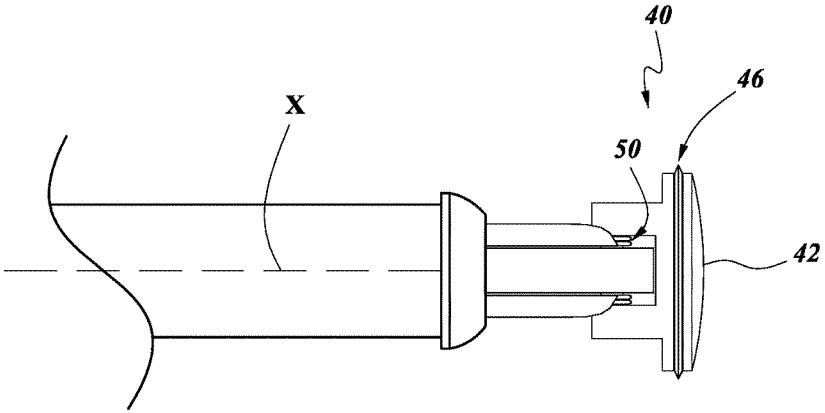
Figure 8:
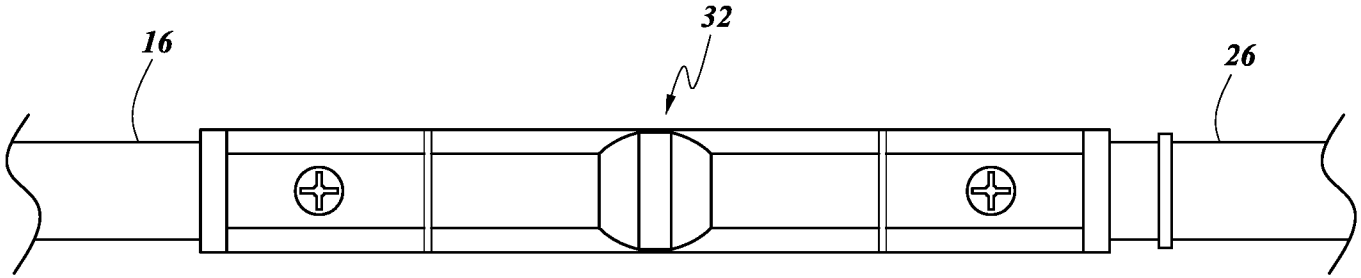
FIG. 8 is an exploded view of portions of the first and second elongate members and the connecting member with a flexible joint.

The cleaning device 100 can have a first elongate member assembly 10 (e.g., first shaft or stick) and a second elongate member assembly 20 (e.g., second shaft or stick) connected to a connecting member 30. The first and second elongate member assemblies 10, 20 connect to the connecting member 30 via fasteners (e.g., screws, as shown in FIG. 8) that extend through holes in the connecting member 30. However, other suitable mechanisms can be used to couple the first and second elongate member assemblies 10, 20 to the connector 30. For example, the first and second elongate member assemblies 10, 20 can connect to the connecting member 30 via barbs, a press-fit connection, a key-keyhole connection, etc.). Optionally, the connecting member 30 is approximately halfway along the length of the cleaning device 100.

The first elongate member assembly 10 can include an absorbent material 12 wrapped about at least a portion of a first elongate member (e.g., a rod, shaft or stick) 16. Optionally, the absorbent material 12 is wrapped about a majority of the length of the first elongate member 16.

The second elongate assembly 20 can include an absorbent material 22 wrapped about at least a portion of a sleeve 24, where the sleeve 24 is slidably coupled to a second elongate member 26. The sleeve 24 can have a distal portion 25 that can optionally have an angled end surface 25A.

A cap member 40 or end cap can be pivotally coupled to a distal portion 26A of the second elongate member 26 by a pivot joint 44 defined by an axle 44A that extends through the distal portion 26A and two walls 45A, 45B of the cap member 40 that are disposed on either side of the distal portion 26A. The cap member 40 can pivot between a retracted position (see FIGS. 6A-6C) where an end surface 42 of the cap member 40 faces away from (e.g., extends along a plane generally parallel to) the axis X of the second elongate member 26 and a deployed position (see FIGS. 7A-7C) where the end surface 42 faces along (e.g., extends along a plane generally perpendicular to) the axis X. The cap member 40 can optionally be biased by a spring 50 (e.g., a torsion spring) that contacts a surface of the distal portion 26A and a surface of the cap member 40. The spring 50 can optionally bias the cap member 40 into the retracted position and can be pivoted into the deployed position via contact between the distal portion 25 of the sleeve 24 and a surface (e.g., angled surface) 47 of the cap member 40 as the sleeve 24 is slid toward the distal portion 26A of the second elongate member 26 (see FIG. 5).

Once the sleeve 24 is slid toward the proximal end of the second elongate member 26 (see FIG. 3), the distal portion 25 of the sleeve 24 moves out of contact with the surface 47 of the cap member 40 and the cap member 40 is biased toward the retracted position (see FIG. 3) by the spring 50. The cap member 40 can optionally have an annular disk 46 of a flexible material (e.g., made of rubber, plastic, etc.) about its outer edge. The annular disk 46 can optionally be made of a different material (e.g., rubber, flexible plastic) than the rest of the cap member 40 (e.g., rigid plastic). The outer diameter of the cap member 40 with the annular disk 46 is generally about the same or greater than an inner diameter of the barrel of the paintball gun, but which allows the cap member 40 and annular disk 46 to be readily inserted into the barrel of the paintball gun.

The connecting member 30 can optionally be single molded piece with a flexible joint (e.g., made of flexible rubber) 32, that allows the cleaning device 100 to be moved between a first orientation where the first and second elongate member assemblies 10, 20 are generally aligned along the same axis (see FIG. 1), to another orientation where the first and second elongate member assemblies 10, 20 extends at an angle less than 180 degrees relative to each other, the cleaning device 100 bending about the flexible joint of the connecting member 30.

In operation, a user would insert the second elongate member assembly 20 with the cap member 40 in the retracted orientation (e.g., oriented so that the annular disk 46 extends along a plane parallel to the axis X of the second elongate member) into the barrel of the paintball gun so that the absorbent material 22 contacts the inner surface of the barrel and can absorb paint and debris from inside the barrel (e.g. from the inner surface of the barrel). The user would then pull on the cleaning device 100 to withdraw the second elongate member assembly 20 from the barrel, causing the absorbent material 22 to slide relative to the barrel. Additionally, pulling on the cleaning device 100 would cause the sleeve 24 to slide relative to the second elongate member 26 toward the distal end of the second elongate member 26 (e.g., due to a friction force between the absorbent material 22 and the inner surface of the barrel), causing the distal portion 25 to engage the surface 47 of the cap member 40 to pivot the cap member 40 (against the force of the spring 50) into the deployed position. In said deployed position, the annular disk 46 of the cap member 40 extends long a plane substantially perpendicular to the axis X so that the annular disk 46 engages the inner wall of the barrel to squeegee the inner wall and remove paint and broken paintball material from the barrel. Once out of the barrel, or if the user stopped pulling and again pushed the cleaning device 100 into the barrel, the cap member 40 would return to the retracted position (biased to the retracted position by the spring 50) until the user pulled on the cleaning device again 100 to cause the sleeve 24 to engage the cap member 40 (e.g., engage the surface 47 of the cap member 40 with the distal portion 25 of the sleeve 24) to pivot the cap member 40 into the deployed position again.

Advantageously, pivoting the cap member between the retracted position during insertion of the cleaning device 100 into the barrel allows the cap member 40 to remove additional debris from the closed end of the barrel in a way that would not be possible if the cap member 40 was fixed or constantly in the deployed position. If the cap member 40 was fixed in the deployed position aligned with the axis X of the elongate member 26, as the user pushed the cleaning device 100 into the barrel, the cap member 26 would push debris into the closed end of the barrel, therefore failing to properly clean the barrel, which might result in continued suboptimal operation of the paintball gun.

Additionally, the cleaning device 100 with the cap member 40 that moves between a retracted position (e.g., where the annular disk 46 extends along a plane substantially parallel to the axis X of the second elongate member 26) during insertion of the cleaning device 100 or swab into the barrel, and a deployed position (e.g., where the annular disk 46 extends along a plane substantially perpendicular to the axis X of the second elongate member 26) during removal of the cleaning device 100 or swab from the barrel advantageously removes more debris from the closed end of the barrel than a swab that had a cap member angled at smaller angle (e.g., non-parallel angle relative to axis of swab stick) in the retracted position. Having the cap member 40 angled along a plane substantially parallel to the axis X of the second elongate member 26 during insertion allows the annular disk 46 to contact the closed end of the barrel in an orientation aligned with the axis of the second elongate member 26, so that when the cleaning device 100 is pulled out of the barrel the cap member 40 rotates to an orientation generally perpendicular to the axis X of the second elongate member 26, thereby optimizing (e.g., maximizing) the amount of debris (e.g., broken paint ball fragments) captured by the cap member 40 as it pivots from the retracted to the deployed orientation.

By having the cap member 40 in the retracted orientation during insertion of the cleaning device 100 into the barrel of the paintball gun, the cap member 40 can advantageously get past debris in the barrel, especially debris proximal the closed end of the barrel. The cap member 40 is then moved to the deployed position as the user pulls the cleaning device 100 out of the barrel, allowing the cap member 40 to pull the debris from the closed end of the barrel at the same time the annular disk 46 squeegeed the inner surface of the barrel and (optionally) at the same time the absorbent material absorbed paint from the broken paintballs in the barrel.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A cleaning assembly for a paintball gun barrel, comprising:

a first shaft having longitudinal axis and extending from a proximal portion to a distal portion;

a second shaft having a longitudinal axis and extending from a proximal portion to a distal portion;

a connector having openings at opposite ends of the connector configured to receive the proximal portions of the first and second shafts therein;

a sleeve slidably coupled over the second shaft and coaxial with the second shaft, the sleeve having a distal edge that extends at an angle relative to the longitudinal axis of the second shaft;

a cap member having a circular outer perimeter and pivotably coupled to the distal portion of the second shaft via a pin that extends through the distal portion of the second shaft and a pair of walls of the cap member disposed on opposite sides of the distal portion of the second shaft, the cap member having an angled edge configured to engage the distal edge of the sleeve, the cap member configured to pivot between a first orientation where the circular outer perimeter extends along a plane that is spaced from and substantially parallel to the longitudinal axis of the second shaft and a second orientation where the circular outer perimeter extends along a plane that is substantially perpendicular to the longitudinal axis of the second shaft; and a torsion spring coupled to a surface of the cap member and a surface of the second shaft and configured to exert a force on the cap member to bias the cap member to the first position, wherein sliding the sleeve toward the distal portion of the second shaft causes the distal edge of the sleeve to engage the angled edge of the cap member to pivot the cap member from the first orientation toward the second orientation against the force of the torsion spring, and wherein sliding the sleeve toward the proximal portion of the second shaft causes the distal edge of the sleeve to disengage from the angled edge of the cap member, causing the torsion spring to bias the cap member to the first orientation, the circular outer perimeter of the cap member extending distally of a distal end of the second shaft when in the first orientation.

2. The assembly of claim 1, wherein the cap member comprises an annular disk of resilient material that defines the circular outer perimeter, the annular disk configured to contact an inner surface of a barrel of a paintball gun when inserted therein and in the second orientation to thereby squeegee the inner surface when pulled out of the barrel.

3. The assembly of claim 2, wherein the annular disk is made of a material different than the rest of the cap member.

4. The assembly of claim 3, wherein the annular disk is made of rubber.

5. The assembly of claim 1, wherein the connector further comprises a hinge portion configured to allow pivoting of the first and second shafts relative to each other.

6. The assembly of claim 1, further comprising an absorbent material disposed over the first shaft and the sleeve and configured to contact an inner surface of a barrel of a paintball gun when inserted therein.

7. The assembly of claim 1, wherein first and second shafts are coupled to the connector by fasteners that extend through the connector wall and the first and second shafts.

8. The assembly of claim 1, wherein the distal end of the second shaft is disposed between the pair of walls of the cap member.

9. A cleaning assembly for a paintball gun barrel, comprising:

a shaft having a longitudinal axis and extending from a proximal portion to a distal portion;

a sleeve slidably coupled over the shaft and coaxial with the shaft, the sleeve having a distal edge that extends at an angle relative to the longitudinal axis of the shaft;

a cap member having a circular outer perimeter and pivotably coupled to the distal portion of the shaft via a pin that extends through the distal portion of the shaft and a pair of walls of the cap member disposed on opposite sides of the distal portion of the shaft, the cap member having an angled edge configured to engage the distal edge of the sleeve, the cap member configured to pivot between a first orientation where the circular outer perimeter extends along a plane that is spaced from and substantially parallel to the longitudinal axis of the shaft and a second orientation where the circular outer perimeter extends along a plane that is substantially perpendicular to the longitudinal axis of the shaft; and a torsion spring coupled to a surface of the cap member and a surface of the shaft and configured to exert a force on the cap member to bias the cap member to the first position, wherein sliding the sleeve toward the distal portion of the shaft causes the distal edge of the sleeve to engage the angled edge of the cap member to pivot the cap member from the first orientation toward the second orientation against the force of the torsion spring, and wherein sliding the sleeve toward the proximal portion of the shaft causes the distal edge of the sleeve to disengage from the angled edge of the cap member, causing the torsion spring to bias the cap member to the first orientation, the circular outer perimeter of the cap member extending distally of a distal end of the shaft when in the first orientation.

10. The assembly of claim 9, further comprising a second shaft that extends along a longitudinal axis between a proximal end and a distal end, and a connector having openings at opposite ends of the connector configured to receive the proximal portion of the shaft and the proximal end of the second shaft therein.

11. The assembly of claim 9, wherein the cap member comprises an annular disk of resilient material that defines the circular outer perimeter, the annular disk configured to contact an inner surface of a barrel of a paintball gun when inserted therein and in the second orientation to thereby squeegee the inner surface when pulled out of the barrel.

12. The assembly of claim 11 wherein the annular disk is made of a material different than the rest of the cap member.

13. The assembly of claim 12, wherein the annular disk is made of rubber.

14. The assembly of claim 10, wherein the connector further comprises a hinge portion configured to allow pivoting of the shaft relative to the second shaft.

15. The assembly of claim 9, further comprising an absorbent material disposed over the sleeve and configured to contact an inner surface of a barrel of a paintball gun when inserted therein.

16. The assembly of claim 9, wherein the distal end of the shaft is disposed between the pair of walls of the cap member.

* * * * *